United States Patent [19]

Klingenmaier

[11] 4,388,379

[45] Jun. 14, 1983

[54] ELECTRODEPOSITION OF LOW STRESS, HARD IRON ALLOY AND ARTICLE SO PRODUCED

[75] Inventor: Otto J. Klingenmaier, Warren, Mich.

[73] Assignee: General Motors Corporation, Detroit, Mich.

[21] Appl. No.: 257,988

[22] Filed: Apr. 27, 1981

[51] Int. Cl.[3] ..... C25D 3/56

[52] U.S. Cl. ..... 428/613; 204/43 T; 428/681

[58] Field of Search ..... 204/43 T; 428/613, 653, 428/681

[56] References Cited

U.S. PATENT DOCUMENTS 2,507,400 5/1950 De Marinis ..... 204/43 T 4,230,543 10/1980 Kawasaki et al. ..... 204/43 T X

OTHER PUBLICATIONS

S. Glasstone et al., Faraday Soc. Trans., vol. 28, pp. 733–740, (1932).

S. Glasstone et al., Faraday Soc. Trans., vol. 29, pp. 426–429, (1933).

J. C. Sadak et al., Plating and Surface Finishing, pp. 34–37, Apr. 1978.

*Primary Examiner*—G. L. Kaplan

*Attorney, Agent, or Firm*—Douglas D. Fekete

[57] ABSTRACT

A hard iron alloy plate is electrodeposited from a high-conductivity aqueous plating solution containing ferrous ions and cobalt ions. The product plate is composed of up to 6 percent cobalt and the balance iron and is characterized by microscopic cracks perpendicular to the plate surface and effective to reduce the residual tensile stress to below about 60 MPa.

5 Claims, 1 Drawing Figure

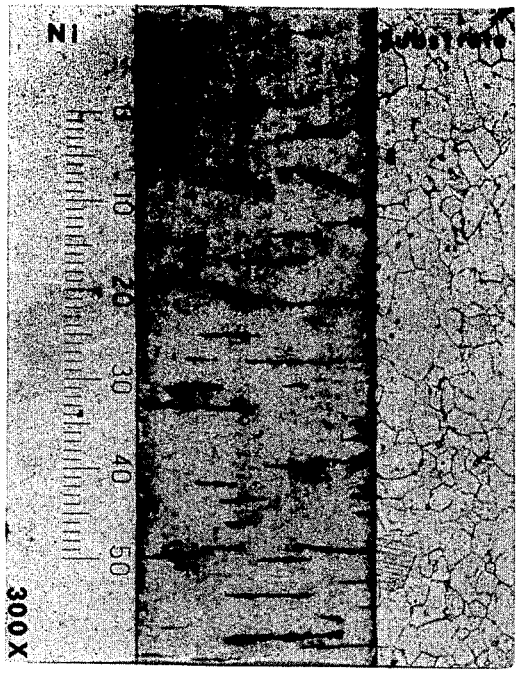
Substrate
Ni
300X

ELECTRODEPOSITION OF LOW STRESS, HARD IRON ALLOY AND ARTICLE SO PRODUCED

BACKGROUND OF THE INVENTION

This invention relates to electrodepositing a hard iron alloy having a relatively low residual stress. More particularly, this invention relates to depositing a wear-resistant plate composed of an iron and cobalt alloy and comprising a high density of stress-relieving microcracks.

Hard iron plates are applied to relatively soft materials, such as aluminum, to provide wear-resistant surfaces. By hard iron, it is meant that the plate has a Vickers hardness greater than about a 400 diamond pyramid hardness (DPH). Problems have been encountered with conventional hard iron plating processes. First, plating baths, which typically contain more than 200 grams per liter (g/l) ferrous ion, must be maintained within a low, relatively narrow pH range. A pH above about 0.4 promotes oxidation of the ferrous ion and precipitation of ferric hydroxide slime and produces plates having rough or poor appearance. Hydrogen evolution increases significantly at below about 0.2 pH. Second, hard iron is plated at relatively high current densities, typically between about 10 to 20 amperes per square decimeter ($A/dm^2$). This requires undesirably high voltages to overcome the high specific resistance of the bath. Another major problem concerns the high residual tensile stress in the product plate. For example, a 15 micrometer ($\mu m$) plate may have a residual stress up to 360 megapascals (MPa). The high stress aggravates adhesion problems that result in spalling. In some cases, the high stress may be sufficient to cause cohesive failure in the substrate, which also may result in spalling. Because the residual stress increases with thickness, hard iron plates have been limited to about 30 $\mu m$.

Therefore, it is an object of this invention to provide a method for electrodepositing an iron alloy onto a substrate to form a hard, wear-resistant, spall-resistant surface, which method utilizes a high-conductivity aqueous ferrous plating solution and requires relatively low voltages to obtain the high current densities necessary for hard iron plating. The method is carried out, and the solution is stable, over a relatively broad pH range above about 0.5. The solution contains cobalt that is codeposited with the iron to form a hard alloy having a relatively low residual stress.

It is also an object of this invention to provide a hard, wear-resistant plate on a substrate, which plate is formed of an iron alloy containing a minor amount of cobalt and comprises a high density of stress-relieving microcracks sufficient to reduce the residual tensile stress and thereby to improve adhesion without sacrificing wearability.

It is a further object of this invention to provide a wear-resistant surface on a substrate formed by an iron alloy plate containing up to about 6 weight percent cobalt, which plate is characterized by a Vickers hardness greater than 550 DPH and a relatively low residual tensile stress on the order of 60 MPa or less. The low stress is independent of thickness and thereby permits thicker, spall-resistant plates.

BRIEF SUMMARY OF THE INVENTION

In accordance with a preferred embodiment, these and other objects are accomplished by electroplating an iron-cobalt alloy onto a metal substrate from a high-conductivity aqueous plating bath containing 90 to 125 g/l ferrous ion and 1.8 to 2.5 g/l cobalt ion, dissolved as chloride salts. The bath also contains sodium and ammonium chlorides in amounts sufficient to reduce the specific resistance below about 6 ohm-centimeter (ohm-cm). The bath pH is adjusted with hydrochloric acid to between 0.5 to 2.5. The relatively high pH range is possible in part because low ferrous content reduces ferric buildup. Also, fluoborate is added to inhibit ferric hydroxide precipitation. The bath temperature is maintained between 56° to 77° C. and preferably between 63° and 70° C. Plating is carried out at a current density between 10 and 25 $A/dm^2$ at the cathodically biased substrate. Because of the relatively low ferrous content and the presence of the conductivity-enhancing salts, the current density is achieved at a relatively low voltage. The high conductivity also improves the throwing power of the bath.

The plate alloy contains 3 to 6 weight percent cobalt, depending upon the specific current density. The Vickers hardness is greater than 550 DPH and preferably between 575 to 650 DPH. The hard plate displays excellent wear-resistance. The plate also has microscopic cracks perpendicular to the substrate or plate surface. The number of cracks at the surface, or intersecting a line parallel to the surface, is greater than 200 per linear centimeter. The microcracks do not affect wearability, but reduce tensile stress to below 60 MPa and thereby reduce spalling. Furthermore, the stress does not increase with thickness. Therefore, thicker plates are applied without spalling.

DESCRIPTION OF THE DRAWINGS

The only FIGURE is a photograph taken with an optical microscope at about 300× magnification and showing an iron-cobalt plate of this invention.

DETAILED DESCRIPTION OF THE INVENTION

In the preferred embodiment, a high-conductivity iron plating bath is prepared having the following composition:

Ferrous chloride ($FeCl_2$): 227 g/l
Cobalt chloride hexahydrate ($CoCl_2.6H_2O$): 8 g/l
Sodium chloride ($NaCl$): 75 g/l
Ammonium chloride ($NH_4Cl$): 75 g/l
Boric acid ($H_3BO_3$): 10 g/l
Ammonium fluoborate ($NH_4BF_4$): 10 g/l
Hydrochloric acid ($HCl$): to 1.0 pH The ammonium fluoborate and the boric acid are initially dissolved in about one-fourth the desired final volume of warm water. The sodium chloride and ammonium chloride are then added with stirring. Hydrochloric acid is added as necessary to adjust the pH to 1.0. The ferrous chloride is added as a concentrated aqueous solution prepared by purifying a commercial technical grade solution to remove organic and inorganic impurities, particularly copper and lead. After the cobalt chloride is added, the solution is diluted to the desired volume. The specific resistance of the solution is about 4.9 ohm-cm at 25° C. The concentrations of ferrous ion and cobalt ion are about 100 g/l and 2 g/l, respectively.

For plating, the solution is maintained between about 65° C. to 70° C. and mechanically stirred. An iron test panel is immersed facing an iron anode covered in a tight-weave polypropylene bag. The panel is cathodically biased with a current density of about 25 A/dm$^2$, based upon the panel surface area facing the anode. The voltage required for this current density was about 45% less than that required to achieve the same density using a conventional 205 g/l ferrous solution having a specific resistance above 7 ohm-cm, although the specific voltage depends upon other factors such as the particular electrode arrangement. The deposition rate is about 300 micrometers per hour.

The product plate has a bright or nearbright luster, slightly brighter than previous cobalt-free hard iron plate. No spalling or other adhesive failure is observed, even for thicknesses of 150 micrometers or more.

The cathode efficiency calculated from the total plate weight is above 96%. The cobalt content as determined by X-ray fluorescence is about 3.5 weight percent. The microhardness is measured by a Vickers pyramid-shaped indentor having a one hundred gram load and directed against a polished edge of a cut made through the plate. The Vickers hardness is about 640 DPH.

The FIGURE shows a magnified cross section of the described iron-cobalt plate labeled Fe-Co. The substrate is an annealed low carbon steel. The plate is about 130 μm thick. A nickel (Ni) overplate is deposited from a nickel sulfamate bath to protect the iron plate while the sample strip is prepared for examination. The strip was cut from an overplated panel and embedded in epoxy resin by casting so that the cut edge was flush with the resin surface. The edge was polished first with progressively finer grit papers between 120 and 600 grit and then with levigated alumina on a polishing wheel. Polishing eliminated scratches made during cutting and provided a metallurgically clean surface for viewing. The polished edge was etched slightly with an alcohol solution containing 4% nitric acid, rinsed and dried. The sample was photographed using an optical microscope having a light source substantially perpendicular to the edge. An arbitrary scale is provided wherein fifty divisions equals 0.25 mm.

As seen in the FIGURE, the iron-cobalt plate comprises a plurality of microscopic cracks extending perpendicular to the plate surface adjacent the nickel overplate interface. The density of microcracks is calculated by counting the cracks intersecting the surface, in a manner similar to the method for calculating density in chrome plates. The microcrack density in the FIGURE is calculated to be about 240 cracks per linear centimeter. Referring to the FIGURE, the cracks extend over only a portion of the plate thickness. Microcracks are rarely deeper than 65 μm and are generally much shorter. As cracks close during plating, new cracks form. Thus, the density may be calculated by counting cracks intersecting a line parallel to the surface and is substantially uniform throughout the plate.

The residual stress of the iron-cobalt plate is measured by a rigid strip method. A 0.30 mm thick annealed steel strip is constrained in a flat position while only one surface is plated. When the constraint is removed, the strip bends to alleviate stress in the plate. The residual stress is calculated by the amount of bending. In the described plate, the residual stress is about 35 MPa.

For the described bath, tensile stress depends upon current density. The stress in a 50 μm plate is about 75 MPa at 5 A/dm$^2$, about 60 MPa at 15 A/dm$^2$ and 25 MPa at 30 A/dm$^2$. Low stress plates have been obtained at current densities as high as 40 A/dm$^2$. Cobalt content and microcrack formation are also related to current density. For a fresh bath, the cobalt content is about 6 weight percent at 5 A/dm$^2$, about 4.3 percent at 15 A/dm$^2$ and 3.2 percent at 30 A/dm$^2$. The cobalt content is slightly less for an aged bath that contains ferric ions. At 5 A/dm$^2$, microcrack density is typically between 75 to 90 cracks per centimeter. At 15 A/dm$^2$, the crack density is typically between 195 to 225 cracks per centimeter. Above 15 A/dm$^2$ the crack density is generally between 210 to 250 cracks per centimeter. Also, the microcracks generally become wider as the current density increases.

While not wishing to be limited to any particular theory, it is believed that the microcracks reduce stress in the iron-cobalt plate. The degree that stress is relieved depends on the density and size of the microcracks. Microcrack formation is believed to be related to cobalt distributed in the iron lattice. The high density of individually small cracks is in marked contrast to the catastrophic substrate tearing and spalling that occurs in a cobalt-free plate. The microscopic cracks do not interfere with desired wear properties of the plate. Also, because new cracks form as others close, the stress is maintained low throughout the thickness of the plate. The stress does not build up as the plate thickness increases and thus does not limit the thickness, whereas the stress in cobalt-free and microcrack-free hard iron plates increases with thickness and essentially limits plating to about 30 micrometers thickness.

The Vickers microhardness also depends somewhat upon the current density. However, a hardness greater than 575 DPH is generally obtained for the preferred bath, even at current densities as low as 5 A/dm$^2$.

The preferred bath is formulated to have a high conductivity. It has been found that low or high ferrous ion concentrations increase the specific resistance, and thus reduce conductivity. Ferrous concentrations between 90 and 125 g/l provide a minimum specific resistance. The addition of conducting salts further reduces the bath resistance. Although ammonium chloride is more effective than sodium chloride to improve conductivity, ammonium chloride alone is not as effective to reduce stress in the plate as an equal weight of an equal part mixture with sodium chloride. In general, a specific resistance of 6 ohm-cm or less is preferred, which is obtained by the addition of 25 g/l each sodium chloride and ammonium chloride. Additional salts further decrease the specific resistance, up to saturation. However, concentrations less than 150 g/l are preferred to avoid salting out problems caused by evaporation or cooling. Although sodium chloride and ammonium chloride are inexpensive and preferred, it is apparent that other salts, particularly univalent metal salts, may be substituted.

In addition to improving conductivity, the relatively low ferrous concentration reduces the formation of ferric ion by oxidation so that the bath is more stable. Also, ammonium fluoborate is added to chelate ferric ion that does form and so further inhibits ferric hydroxide precipitation. Between 5 and 15 g/l ammonium fluoborate does not significantly affect the product plate and is preferred. Because free fluoride produced by fluoborate dissociation may adversely affect plating, a small amount of boric acid, preferably between 5 to 10 g/l, is added to complex any fluoride. The low ferrous concentration and the fluoborate addition permit operation at a pH as high as 2.5, although pH's between 0.5 to 1.0 are preferred.

Although this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for electrodepositing an iron alloy onto a substrate to form a hard, wear-resistant plate having a relatively low residual tensile stress, said method comprising immersing the substrate in a high-conductivity aqueous plating solution having a ferrous ion concentration between 90 and 125 g/l, a cobalt ion concentration between 1.8 and 2.5 g/l, a specific resistance less than about 6 ohm-cm at 25° C. and a pH between 0.5 and 2.5, said solution being maintained at a temperature between 56° to 77° C., and passing direct electrical current through said solution between said substrate as a cathode and an anode to electroplate iron alloy onto said substrate, said current having a density based on the immersed area of the substrate between 5 and 40 A/dm$^2$ and effective to deposit a plate containing up to about 6 weight percent cobalt and having a residual tensile stress below 75 MPa and a Vickers hardness above 550 DPH.

2. A method for electrodepositing an iron alloy onto a metal substrate to form a hard, wear-resistant plate having a relatively low residual tensile stress, said method comprising immersing the substrate in a high-conductivity aqueous plating solution containing between 90 and 125 g/l ferrous ions, between 1.8 and 2.5 g/l cobalt ions, and sodium chloride and ammonium chloride in amounts effective to achieve a specific resistance less than about 5.5 ohm-cm at 25° C., said solution having a pH between 0.5 and 1.0, and being maintained at a temperature between 63° to 70° C., and passing direct electrical current through said solution between said substrate as a cathode and an anode to electroplate iron alloy onto said substrate, said current having a density based on the immersed area of the substrate between 10 and 25 A/dm$^2$, the plate containing between about 3 and 6 weight percent cobalt and being characterized by microcracks perpendicular to the substrate surface in a density greater than 200 cracks per linear cm and effective for reducing the residual tensile stress below 60 MPa.

3. An article of manufacture comprising a metal substrate bearing a hard, wear-resistant, adherent electroplate comprising between about 3 to 6 weight percent cobalt and the remainder essentially iron, said plate being characterized by microscopic cracks perpendicular to the substrate surface and in a density greater than about 200 cracks per linear cm at the plate surface, said cracks being effective to reduce the residual tensile stress to below about 60 MPa, said plate being further characterized by a Vickers hardness greater than 550 DPH.

4. An article of manufacture comprising a metal substrate bearing a hard, wear-resistant iron electroplate having a Vickers hardness greater than 550 DPH and a residual tensile stress less than 75 MPa, said iron electroplate being further characterized as containing cobalt present in an amount up to 6 weight percent.

5. An article of manufacture comprising a metal substrate bearing a hard, wear-resistant electroplate substantially formed of codeposited iron and cobalt, said cobalt being present in an amount between about 3 to 6 weight percent, said electroplate being characterized by a plurality of microscopic cracks perpendicular to the plate surface in a density greater than about 75 cracks per linear centimeter and effective to reduce the residual tensile stress of the plate.

* * * * *